US007241375B2

(12) United States Patent
Johnson et al.

(10) Patent No.: US 7,241,375 B2
(45) Date of Patent: Jul. 10, 2007

(54) HEAVY HYDROCARBON COMPOSITION WITH UTILITY AS A HEAVY LUBRICANT BASE STOCK

(75) Inventors: Jack Wayne Johnson, Clinton, NJ (US); Adeana Richelle Bishop, Bethlehem, PA (US); William Berlin Genetti, Woodbridge, VA (US); Loren Leon Ansell, Baton Rouge, LA (US); Rocco Anthony Fiato, Basking Ridge, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 667 days.

(21) Appl. No.: 10/652,389

(22) Filed: Aug. 29, 2003

(65) Prior Publication Data

US 2005/0150815 A1 Jul. 14, 2005

Related U.S. Application Data

(63) Continuation-in-part of application No. 10/266,344, filed on Oct. 8, 2002, now Pat. No. 6,846,778.

(51) Int. Cl.
*C10M 105/04* (2006.01)
*C10M 101/02* (2006.01)

(52) U.S. Cl. ..... 208/18; 208/19; 508/110; 585/7; 585/13

(58) Field of Classification Search ..... 208/18, 208/19; 585/13
See application file for complete search history.

(56) References Cited

U.S. PATENT DOCUMENTS 2,250,410 A 7/1941 van Peski ..... 260/676
3,711,399 A 1/1973 Estes et al. ..... 208/112
4,181,597 A 1/1980 Yan et al. ..... 208/46
4,335,019 A 6/1982 Bowes et al. ..... 252/450
4,377,469 A 3/1983 Shihabi ..... 208/111
4,388,177 A 6/1983 Bowes et al. ..... 208/111
4,402,866 A 9/1983 Shihabi ..... 252/455
4,431,516 A 2/1984 Baird et al. ..... 208/111
4,431,517 A 2/1984 Nevitt et al. ..... 208/111
4,436,614 A 3/1984 Olbrich et al. ..... 208/89

(Continued)

FOREIGN PATENT DOCUMENTS

EP 0147873 B1 3/1988

(Continued)

*Primary Examiner*—Ellen M. McAvoy
(74) *Attorney, Agent, or Firm*—Mark D. Marin; Liza Montalvo

(57) ABSTRACT

A heavy hydrocarbon composition with utility as a heavy hydrocarbon base stock comprising at least 95 wt % paraffin molecules, of which at least 90 wt % are isoparaffin, containing hydrocarbon molecules having consecutive numbers of carbon atoms, is a liquid at 100° C., at which temperature its kinematic viscosity, as measured by ASTM D-445, is above 8 cSt, has an initial boiling point of least 850° F. (454° C.) and an end boiling point of at least 1000° F. (538° C.), wherein the branching index (BI), as measured by the percentage of methyl hydrogens, and the branching proximity ($CH_2$>4), as measured by the percentage of recurring methylene carbons which are four or more carbon atoms removed from an end group or branch, of said isoparaffinic hydrocarbon molecules, are such that:

(a) $BI-0.5(CH_2>4)<15$; and (b) $BI+0.85(CH_2>4)<45$;

as measured over the heavy hydrocarbon composition as a whole.

27 Claims, 1 Drawing Sheet

U.S. PATENT DOCUMENTS

| | | | | |
|---|---|---|---|---|
| 4,510,045 | A | 4/1985 | Dessau | 208/111 |
| 4,568,449 | A | 2/1986 | Angmorter et al. | 208/216 |
| 4,594,146 | A | 6/1986 | Chester et al. | 208/111 |
| 4,684,756 | A | 8/1987 | Derr, Jr. | 585/330 |
| 4,784,747 | A | 11/1988 | Shihabi | 208/111 |
| 4,808,296 | A | 2/1989 | Chen et al. | 208/111 |
| 4,908,120 | A | 3/1990 | Bowes et al. | 208/59 |
| 4,919,788 | A | 4/1990 | Chen et al. | 208/59 |
| 4,921,593 | A | 5/1990 | Smith | 208/59 |
| 4,954,325 | A | 9/1990 | Rubin et al. | 423/328 |
| 4,975,177 | A | 12/1990 | Garwood et al. | 208/27 |
| 5,015,361 | A | 5/1991 | Anthes et al. | 208/111 |
| 5,017,535 | A | 5/1991 | Schoonhoven et al. | 502/30 |
| 5,037,528 | A | 8/1991 | Garwood et al. | 208/27 |
| 5,059,299 | A | 10/1991 | Cody et al. | 208/27 |
| 5,075,269 | A | 12/1991 | Degnan et al. | 502/77 |
| 5,110,445 | A | 5/1992 | Chen et al. | 208/96 |
| 5,110,573 | A | 5/1992 | Johnson | 423/328 |
| 5,146,022 | A | 9/1992 | Buchanan et al. | 585/12 |
| 5,164,169 | A | 11/1992 | Rubin | 423/709 |
| 5,164,170 | A | 11/1992 | Rubn | 423/709 |
| 5,208,403 | A | 5/1993 | Buchanan et al. | 585/7 |
| 5,232,579 | A | 8/1993 | Absil et al. | 208/113 |
| 5,275,719 | A | 1/1994 | Baker, Jr. et al. | 208/58 |
| 5,276,229 | A | 1/1994 | Buchanan et al. | 585/255 |
| 5,284,985 | A | 2/1994 | Girgis et al. | 585/310 |
| 5,288,395 | A | 2/1994 | Marler et al. | 208/58 |
| 5,358,628 | A | 10/1994 | Apelian et al. | 208/60 |
| 5,362,378 | A | 11/1994 | Borghard et al. | 208/138 |
| 5,399,337 | A | 3/1995 | Schmitt | 423/705 |
| 5,405,596 | A | 4/1995 | Moini et al. | 423/705 |
| 5,419,830 | A | 5/1995 | Chou et al. | 208/111 |
| 5,456,820 | A | 10/1995 | Forbus, Jr. et al. | 208/111 |
| 5,475,178 | A | 12/1995 | Del Rossi et al. | 585/455 |
| 5,488,191 | A | 1/1996 | Chu et al. | 585/10 |
| 5,498,821 | A | 3/1996 | Ryan et al. | 585/750 |
| 5,516,736 | A | 5/1996 | Chang et al. | 502/64 |
| 5,603,822 | A | 2/1997 | Forbus, Jr. et al. | 208/111 |
| 5,603,824 | A | 2/1997 | Kyan et al. | 208/208 |
| 5,611,192 | A | 3/1997 | Weder | 53/221 |
| 5,612,270 | A | 3/1997 | Beck et al. | 502/64 |
| 5,637,784 | A | 6/1997 | Chu et al. | 585/14 |
| 5,643,440 | A | 7/1997 | Borghard et al. | 208/58 |
| 5,689,031 | A | 11/1997 | Berlowitz et al. | 585/734 |
| 5,730,858 | A | 3/1998 | Olivier et al. | 208/28 |
| 5,779,882 | A | 7/1998 | Chester et al. | 208/120 |
| 5,780,382 | A | 7/1998 | Chang et al. | 502/309 |
| 5,780,703 | A | 7/1998 | Chang et al. | 585/732 |
| 5,827,491 | A | 10/1998 | Emerson et al. | 423/328.2 |
| 5,833,840 | A | 11/1998 | Absil et al. | 208/120 |
| 5,849,968 | A | 12/1998 | Beck et al. | 585/481 |
| 5,854,170 | A | 12/1998 | Chang et al. | 502/308 |
| 5,885,438 | A | 3/1999 | Apelian et al. | 208/27 |
| 5,911,874 | A | 6/1999 | Cody et al. | 208/87 |
| 5,935,417 | A | 8/1999 | Cody et al. | 208/87 |
| 5,961,951 | A | 10/1999 | Kennedy et al. | 423/708 |
| 5,976,201 | A | 11/1999 | Barry et al. | 44/413 |
| 5,976,351 | A | 11/1999 | Apelian et al. | 208/27 |
| 5,993,644 | A | 11/1999 | Xiao et al. | 208/89 |
| 6,008,164 | A | 12/1999 | Aldrich et al. | 508/110 |
| 6,013,171 | A | 1/2000 | Cook et al. | 208/27 |
| 6,051,129 | A | 4/2000 | Harris et al. | 208/138 |
| 6,063,973 | A | 5/2000 | Sen et al. | 585/18 |
| 6,080,301 | A | 6/2000 | Berlowitz et al. | 208/18 |
| 6,080,904 | A | 6/2000 | Chang et al. | 585/751 |
| 6,090,989 | A | 7/2000 | Trewella et al. | 585/13 |
| 6,096,189 | A | 8/2000 | Cody et al. | 208/87 |
| 6,150,576 | A | 11/2000 | Jiang et al. | 585/18 |
| 6,179,994 | B1 | 1/2001 | Clark et al. | 208/27 |
| 6,180,068 | B1 | 1/2001 | Boyd et al. | 422/195 |
| 6,180,575 | B1 | 1/2001 | Nipe | 508/227 |
| 6,190,532 | B1 | 2/2001 | Degnan et al. | 208/27 |
| 6,210,563 | B1 | 4/2001 | Tsao et al. | 208/138 |
| 6,217,747 | B1 | 4/2001 | Chang et al. | 208/112 |
| 6,231,749 | B1 | 5/2001 | Degnan et al. | 208/27 |
| 6,261,441 | B1 | 7/2001 | Gentry et al. | 208/58 |
| 6,264,826 | B1 | 7/2001 | Xiao et al. | 208/18 |
| 6,277,355 | B1 | 8/2001 | Kennedy et al. | 423/705 |
| 6,287,454 | B1 | 9/2001 | Forbus, Jr. et al. | 208/28 |
| 6,294,077 | B1 | 9/2001 | Dougherty et al. | 208/27 |
| 6,306,362 | B1 | 10/2001 | Han et al. | 423/702 |
| 6,310,265 | B1 | 10/2001 | Chester et al. | 585/739 |
| 6,319,487 | B1 | 11/2001 | Liu et al. | 423/706 |
| 6,322,692 | B1 | 11/2001 | Cody et al. | 208/18 |
| 6,337,010 | B1 | 1/2002 | Hofer | 208/58 |
| 6,339,051 | B1 | 1/2002 | Carey et al. | 508/391 |
| 6,346,498 | B1 | 2/2002 | Chang et al. | 502/64 |
| 6,362,123 | B1 | 3/2002 | Tsao et al. | 502/74 |
| 6,375,830 | B1 | 4/2002 | Clark et al. | 208/27 |
| 6,416,654 | B1 | 7/2002 | Chou et al. | 208/27 |
| 6,420,063 | B1 | 7/2002 | Ozin et al. | 429/40 |
| 6,504,075 | B2 | 1/2003 | Beck et al. | 585/475 |
| 6,506,703 | B1 | 1/2003 | Kao et al. | 502/66 |
| 6,627,779 | B2 | 9/2003 | O'Rear | 585/302 |
| 6,833,065 | B2 * | 12/2004 | O'Rear | 208/19 |
| 6,846,778 | B2 * | 1/2005 | Johnson et al. | 508/110 |
| 7,018,525 | B2 * | 3/2006 | Miller et al. | 208/27 |
| 2001/0001449 | A1 | 5/2001 | Kiliany et al. | 208/111.01 |
| 2001/0004972 | A1 | 6/2001 | Miller et al. | 208/18 |
| 2001/0006154 | A1 | 7/2001 | Krug et al. | 208/18 |
| 2002/0003102 | A1 | 1/2002 | O'Rear et al. | 208/18 |

FOREIGN PATENT DOCUMENTS

| | | |
|---|---|---|
| EP | 0635557 A1 | 1/1995 |
| EP | 0707057 A1 | 4/1996 |
| EP | 0909304 B1 | 4/1999 |
| EP | 0668342 B1 | 8/1999 |
| GB | 772478 | 4/1957 |
| GB | 1582789 | 1/1981 |
| GB | 2109402 | 6/1983 |
| GB | 2311789 | 10/1997 |
| WO | WO 96/13563 | 5/1996 |
| WO | WO 96/26993 | 9/1996 |
| WO | WO 96/34930 | 11/1996 |
| WO | WO 97/18278 | 5/1997 |
| WO | WO 98/18883 | 5/1998 |
| WO | WO 99/35087 | 7/1999 |
| WO | WO 01/57166 A1 | 8/2001 |
| WO | WO 02/070627 A2 | 9/2002 |

* cited by examiner

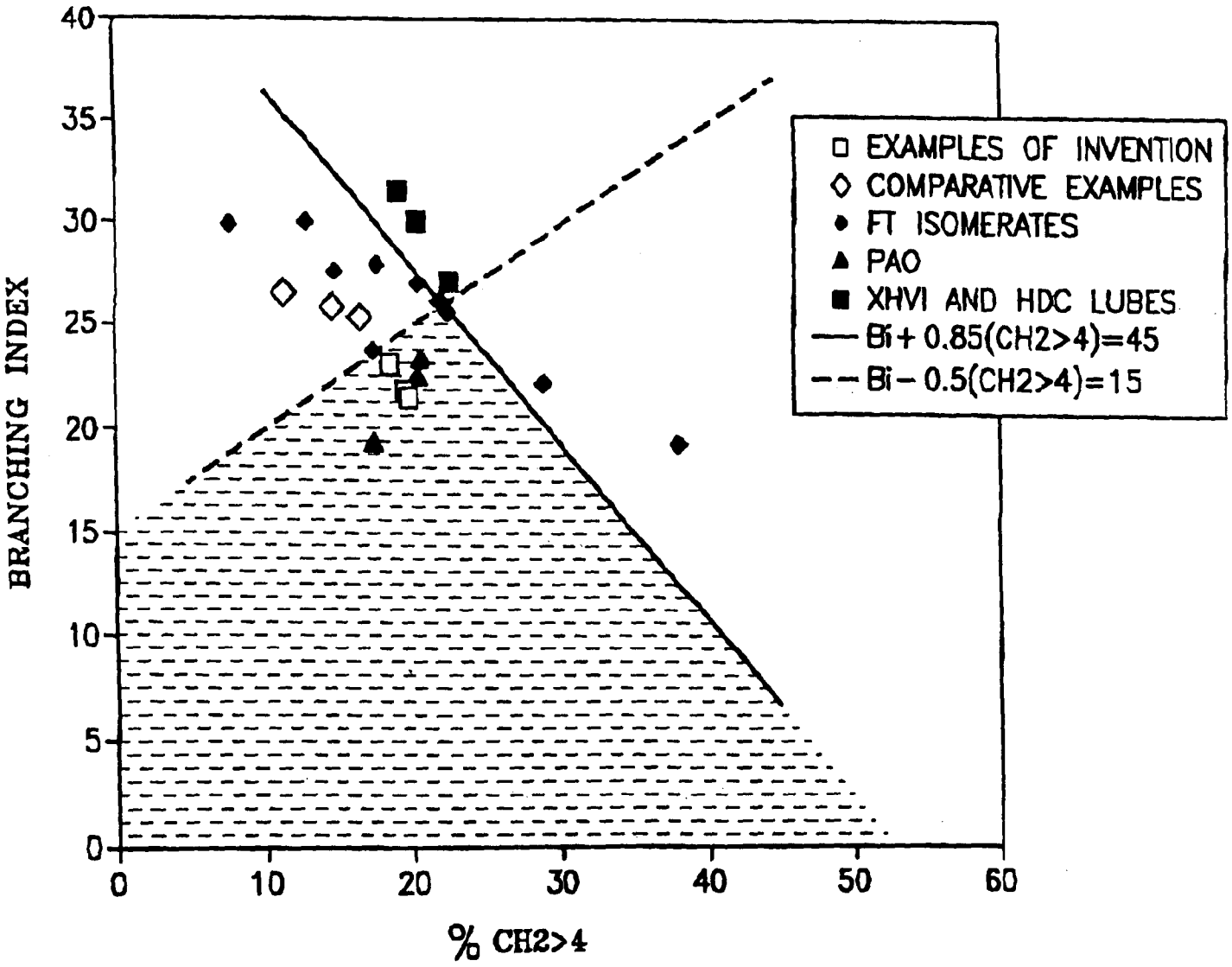
EXAMPLES OF INVENTION
COMPARATIVE EXAMPLES
FT ISOMERATES
PAO
XHVI AND HDC LUBES
Bi + 0.85(CH2>4)=45
Bi − 0.5(CH2>4)=15
BRANCHING INDEX
% CH2>4
0
5
10
15
20
25
30
35
40
0
10
20
30
40
50
60

HEAVY HYDROCARBON COMPOSITION WITH UTILITY AS A HEAVY LUBRICANT BASE STOCK

This application is a Continuation-In-Part of U.S. Ser. No. 10/266,344 filed Oct. 8, 2002 now U.S. Pat. No. 6,846,778.

BACKGROUND OF THE DISCLOSURE

Field of the Invention

The invention relates to a heavy hydrocarbon composition useful as a heavy lubricant base stock, produced by isomerizing Fischer-Tropsch wax, to a heavy lubricant base stock and to a heavy lubricant formed from the base stock.

BACKGROUND OF THE INVENTION

Heavy lubricants are used for high viscosity applications in which a lubricant based on a lighter oil will not provide sufficient lubrication between moving parts, such as heavy machine oils, gear boxes, deep drawing oils, and manual transmissions. A heavy lubricant is formed by combining a heavy lubricant base stock, which is a heavy oil possessing lubricating oil qualities, with one or more lubricant additives. Most heavy lubricant base stocks are derived from naturally occurring petroleum oil and contain aromatic unsaturates, including polynuclear aromatics, along with sulfur and nitrogen containing compounds. These compounds tend to reduce the viscosity and stability of the oil and the heavy lubricant. Refining the oil to remove these components results in a low yield of the product oil. Heavy paraffins can be refined to low levels of unsaturates and heteroatom compounds, but have unacceptably high pour and cloud points.

There is a need for a relatively pure or premium quality, heavy hydrocarbon composition that is a liquid at least at the temperature of use and that has utility as or in a heavy lubricant base stock.

U.S. Pat. No. 6,090,989 (Trewella et al) discloses a liquid hydrocarbon composition of paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2$>4), are such that:

(a) $BI-0.5(CH_2>4)>15$; and (b) $BI+0.85(CH_2>4)<45$;

as measured over the liquid hydrocarbon composition as a whole. The base stocks of U.S. Pat. No. 6,090,989 are characterized by very low pour points (PP) of less than or equal to −18° C., and the kinematic viscosities range from preferably about 4 cSt to about 8 cSt at 100° C. While the compositions according to U.S. Pat. No. 6,090,989 have excellent utility as lubricant base stocks, certain applications require the use of heavy lubricants, especially with a kinematic viscosity at 100° C. greater than 8 cSt. This will generally require the presence of relatively long chain hydrocarbon molecules in the base stock. However, increase of the chain length of hydrocarbon molecules in a hydrocarbon mixture will usually result in an increase of pour and cloud points, which is undesirable. Alternatively, additives such as viscosity index improvers and pour and cloud point depressants could be used to impart the desired properties to the lubricant. Apart from that the use of additives is costly, additives tend to deteriorate with use. Therefore, it was an object of the invention to provide for a composition with relatively high viscosity, good lubricity and oxidation stability, but low pour and cloud points.

Also, there is always a need for hydrocarbon compositions which are useful, for example as a heavy white oil, a pharmaceutical oil, a carrier or base for medicinal formulations, in chemical and the pharmaceutical manufacturing and the like. Such applications generally require a pure and chemically inert material, which will for instance not cause allergies in medicinal applications. In other words, there is a need for a hydrocarbon composition which is very low in aromatics and heteroatom containing components.

The present invention provides for a heavy hydrocarbon composition which has both high viscosity and low pour and cloud points.

SUMMARY OF THE INVENTION

The invention relates to a relatively pure, premium quality, heavy hydrocarbon composition useful as or in a heavy lubricant base stock, to a heavy lubricant base stock, and to a heavy lubricant formed from the heavy lubricant base stock.

The heavy hydrocarbon composition comprises mostly (e.g. ≧98 wt %) saturated, paraffinic hydrocarbon molecules, is an oily liquid having a kinematic viscosity at 100° C. greater than 8 cSt (centistokes), with an initial (5%) boiling point of at least 850° F. (454° C.) and an end (95%) boiling point of at least 1,000° F. (538° C.). The heavy hydrocarbon composition comprises at least 95 wt % paraffin molecules, of which at least 90 wt % are isoparaffins. Isoparaffins make up for at least 90 wt. % of the paraffin molecules of the heavy hydrocarbon composition according to the invention. The heavy hydrocarbon composition contains hydrocarbon molecules having consecutive numbers of carbon atoms. The extent of branching of the isoparaffinic hydrocarbon molecules, as measured by the percentage of methyl hydrogens, hereinafter referred to as the branching index (BI), and the proximity of the branches (or branching proximity), as measured by the percentage of recurring methylene carbons which are four or more carbon atoms removed from an end group or branch ($CH_2$>4), are such that:

(a) $BI-0.5(CH_2>4)<15$; and (b) $BI+0.85(CH_2>4)<45$;

as measured over the heavy hydrocarbon composition as a whole. The heavy hydrocarbon composition has utility in or as a heavy lubricant base stock.

The branching proximity ($CH_2$>4) describes the n-paraffinic character of a paraffin molecule in the hydrocarbon. Generally, in order to obtain good lubricity, compositions are desired that contain paraffin molecules having a relatively high n-paraffinic character, i.e. a small number of branches and/or short branches. However, paraffins having a relatively high n-paraffinic character are expected to give undesired pour and cloud points, because n-paraffins tend to crystallize out from paraffin mixtures at a rather high temperature.

The branching index, as measured by the percentage of methyl hydrogens, is a measure of the number of branches attached to the backbone. If there is an abundance of branches and the branches are primarily methyl groups, the branching index will be large.

For instance, given a certain total number of carbon atoms, a paraffin molecule with a large number of branches and long branches on a relatively short backbone, i.e. a rather small n-paraffinic character, will have a branching proximity ($CH_2$>4) which is relatively small. A paraffin molecule having the same total number of carbon atoms, but with a small number of branches and/or branches which have a larger distance to each other or to an end group, and with a relatively long backbone, i.e. a paraffin molecule with a more n-paraffinic character, will have a branching proximity ($CH_2$>4) which is relatively large.

U.S. Pat. No. 6,090,989 relates to a liquid hydrocarbon composition in which BI−0.5($CH_2$>4)>15. It has now surprisingly been found that heavy hydrocarbon compositions with a relatively high viscosity, but low pour and cloud points may be obtained if (a) BI−0.5($CH_2$>4)<15. In other words, according to the invention, the branching proximity ($CH_2$>4) is rather large, as compared to the compositions exemplified in U.S. Pat. No. 6,090,989. This finding was unexpected because the heavy hydrocarbon compositions according to the invention contain paraffin molecules with a more n-paraffinic character, as expressed by a relatively large branching proximity, and still have very low pour and cloud points. In fact, the finding is contrary to the common belief that low pour and cloud points require a small n-paraffinic and a relatively large isoparaffinic character.

The BI is preferably less than 24 and the branching proximity, ($CH_2$>4), is preferably greater than 17.

In another embodiment, the invention relates to a heavy lubricant formed by combining the heavy lubricant base stock of the invention with one or more lubricant additives. While the heavy hydrocarbon composition of the invention is useful as a heavy lubricant base stock, it will have other uses such as, for example, a heavy white oil, a pharmaceutical oil, as a carrier or base for medicinal formulations, in chemical and pharmaceutical manufacturing, and the like. Thus, in further embodiments the invention comprises one or more of the following, of or in which at least a portion uses or is based on the heavy hydrocarbon composition of the invention; a heavy white oil, a pharmaceutical oil, a carrier or base for medicinal formulations, chemical and pharmaceutical manufacturing processes.

In a further embodiment, the invention relates to a base stock comprising the heavy hydrocarbon composition according to the invention. In other words, this embodiment relates to the use of the heavy hydrocarbon composition in or as a base stock. Preferably, the base stock according to the invention consists of the heavy hydrocarbon composition.

BRIEF DESCRIPTION OF THE DRAWING

The FIGURE is a graph plotting the BI and % $CH_2$>4 values derived from NMR spectra of the heavy hydrocarbon compositions of the invention, the comparative examples of this application, and the data of U.S. Pat. No. 6,090,989 which includes other hydrocarbon compositions, as has been described above. The disclosure of U.S. Pat. No. 6,090,989 is incorporated herein in its entirety by reference. The shaded area on the plot defines the NMR parameter space of the heavy hydrocarbon compositions of the invention. Only the heavy hydrocarbon composition of this invention which are preferably derived from Fischer-Tropsch synthesized waxy hydrocarbons and PAO base stocks fall in this area of parameter space. The molecular composition of the PAO stocks are different from the heavy hydrocarbon compositions of the invention in that (i) they do not contain hydrocarbon molecules having consecutive numbers of carbon atoms, (ii) the percentage of hydrogen atoms from $CH_3$ groups on the molecules is below 15, whereas those for the heavy hydrocarbon composition of the invention is preferably above 20, (iii) the percentage of hydrogen atoms from CH groups for the PAO stocks is preferably above 3, whereas for the heavy hydrocarbon compositions of the invention it is preferably less than 2.

DETAILED DESCRIPTION

The invention provides for a heavy hydrocarbon composition comprising at least 95 wt % paraffin molecules, of which at least 90 wt % are isoparaffin, containing hydrocarbon molecules having consecutive numbers of carbon atoms, is a liquid at 100° C., at which temperature its kinematic viscosity is above 8 cSt (ASTM D-445), has respective initial and end boiling points of at least 850 and 1000° F. (454 and 538° C.), wherein the branching index (BI), as measured by the percentage of methyl hydrogens, and the branching proximity ($CH_2$>4), as measured by the percentage of recurring methylene carbons which are four or more carbon atoms removed from an end group or branch, of said isoparaffinic hydrocarbon molecules, are such that:

(a) BI−0.5($CH_2$>4)<15; and (b) BI+0.85($CH_2$>4)<45;

as measured over the heavy hydrocarbon composition as a whole.

Preferably, the heavy hydrocarbon composition of the invention is produced from Fischer-Tropsch wax and comprises mostly (≧98 wt %) saturated, paraffinic hydrocarbons, of which at least 90 wt % are non-cyclic hydrocarbons and no more than 10 wt % cyclic hydrocarbons. At least 90 and preferably at least 95 wt %, more preferably at least 98 wt %, most preferably at least 99 wt % of the paraffinic hydrocarbon molecules are isoparaffins. While paraffinic cyclic hydrocarbons may be present in an amount of up to 5 wt %, more typically they will not exceed 1 wt %, if present.

The kinematic viscosity of the heavy hydrocarbon compositions of the invention at 100° C., as measured according to ASTM D-445, is greater than 8 cSt. The heavy hydrocarbon composition of the invention contains molecules having consecutive numbers of carbon atoms and preferably at least 95 wt °/$C_{30+}$ hydrocarbon molecules. The initial boiling point is at least 850° F. (454° C.), preferably 900° F. (482° C.) and the end boiling point is at least 1,000° F. (538° C.). The heavy hydrocarbon composition is typically a liquid at the temperature and pressure conditions of use and typically, but not always, at ambient conditions of 75° F. (24° C.) and one atmosphere (101 kPa) pressure. The initial and end boiling points values referred to herein are nominal and refer to the T5 and T95 cut points (boiling temperatures) obtained by gas chromatograph simulated distillation (GCD), using the method set forth below.

The extent of branching of the isoparaffinic hydrocarbon components, as measured by the percentage of methyl ($CH_3$) hydrogens or branching index (BI), and the proximity of the branches (or branching proximity), as measured by the percentage of recurring methylene carbons which are four or more carbon atoms removed from an end group or branch ($CH_2$>4), are such that:

(a) BI−0.5($CH_2$>4)<15; and (b) BI+0.85($CH_2$>4)<45;

as measured over the heavy hydrocarbon composition as a whole. The BI is preferably less than 24 (BI<24) and the branching proximity is preferably greater than 17 (($CH_2$>4) >17). The heavy hydrocarbon composition also preferably contains at least 75 wt % of $C_{35+}$ hydrocarbon molecules.

The heavy hydrocarbon composition of the invention is different from one derived from petroleum oil, slack wax, a PAO oil and the lubricant base stock disclosed in U.S. Pat. No. 6,090,989, which was obtained by isomerizing Fischer-Tropsch wax.

Sulfur, nitrogen and metals in the form of hydrocarbon compounds containing them are present in amounts of less than 50 wppm. Heavy hydrocarbon compositions of the invention that have been made from Fischer-Tropsch wax usually contain less than 1 wppm sulfur, nitrogen and metals. These were not detectable by X-ray or Antek Nitrogen tests.

While the heavy hydrocarbon composition of the invention is a mixture of various molecular weight paraffinic hydrocarbons, the residual normal paraffin content remaining after hydrodewaxing is less than 5 wt % and more typically less than 1 wt %, with at least 95% of the oil molecules containing at least one branch, at least half of which are methyl branches. At least half, and more preferably at least 75% of the remaining branches are ethyl, with less than 25% and preferably less than 15% of the total number of branches having three or more carbon atoms. The total number of branch carbon atoms is typically less than 25%, preferably less than 20% and more preferably no more than 15% (e.g., 10–15%) of the total number of carbon atoms comprising the hydrocarbon molecules.

PAO oils are an oligomerization product of even carbon numbered linear alpha olefins, typically 1-decene. The PAO oil molecules therefore comprise a mixture of even carbon numbered hydrocarbon molecules, differing from each other in the number of carbon atoms by multiples of the number of carbon atoms in the linear alpha olefin starting monomer. Even if a mixture of linear alpha olefin monomers having even numbers of carbon atoms (e.g., decene and dodecene) were oligomerized to form a heavy lubricant base stock oil, the number of carbon atoms in the resulting hydrocarbon molecules would still have even numbers of carbon atoms. This is different from the mixture of consecutive numbered hydrocarbon molecules of the heavy hydrocarbon composition of the invention, which comprise hydrocarbon molecules having both even and odd numbers of carbon atoms and which differ from each other by consecutive numbers of carbon atoms (e.g., 1, 2, 3, 4, 5, 6, 7 and more carbon atoms).

That hydrocarbon molecules of the heavy hydrocarbon composition of the invention differ from each other by consecutive numbers of carbon atoms is a consequence of the Fischer-Tropsch hydrocarbon synthesis reaction from which the wax feed, which was isomerized to form the heavy hydrocarbon composition of the invention may be produced. While a preferred heavy hydrocarbon composition is prepared from synthetic sources rather than sources on a mineral oil basis, and may thus be termed a synthetic heavy hydrocarbon composition, the heavy hydrocarbon composition of the invention is not limited to be based on synthetic sources. In a preferred embodiment, however, the heavy hydrocarbon composition is based on a synthetic source, and is more preferably based on a Fischer-Tropsch product.

In the Fischer-Tropsch hydrocarbon synthesis reaction the source of carbon atoms is CO and the hydrocarbon molecules are built up one carbon atom at a time. In contrast to an oil based on PAO, then hydrocarbon molecules of the heavy hydrocarbon composition of the invention have a more linear structure, comprising a relatively long backbone with short and few branches. The classic textbook description of a PAO is a star-shaped molecule, and in particular tridecane, which is illustrated as three decane molecules attached at a central point. While an ideal star-shaped molecule is theoretical, nevertheless PAO molecules have fewer and longer branches than the hydrocarbon molecules that make up the base stock of the invention.

Thus, the molecular make up of a heavy hydrocarbon composition of the invention preferably comprises at least 95 wt % isoparaffins (with no more than 5 wt % saturated cyclics) having a relatively linear molecular structure, with less than half the branches having two or more carbon atoms and less than 25% of the total number of carbon atoms present in the branches. In contrast to the present invention, in the molecular make-up of a PAO oil, more than half the branches contain two or more carbon atoms and more than 25°/ of the total number of carbon atoms are in the branches.

As those skilled in the art know, a lubricant base stock, sometimes also referred to as a lubricating or lube oil base stock, including a heavy lubricant base stock, is an oil boiling in the lubricating oil range, having a lubricating quality and is useful for preparing various lubricants such as lubricating oils and greases. In the present invention the heavy hydrocarbon composition boils in the heavy lubricant oil range. Fully formulated heavy lubricants or heavy lubricating oils are prepared by adding to the heavy lubricant base stock an effective amount of at least one additive or, more typically, an additive package containing more than one additive. Illustrative, but non-limiting examples of such additives include one or more of a detergent, a dispersant, an antioxidant, an antiwear additive, an extreme pressure additive, a pour point depressant, a VI improver, a friction modifier, a demulsifier, an antioxidant, an antifoamant, a corrosion inhibitor, and a seal swell control additive.

A heavy hydrocarbon composition of the invention preferably comprises a dewaxed oil, and has low temperature properties able to meet target specifications or requirements and will be a clear and bright, oily liquid at the temperature and pressure conditions under which it is used. Typically, but not always, it will be an oily liquid at room temperature and pressure conditions of 75° F. (24° C.) and one atmosphere (101 kPa) pressure and is an oily liquid at this pressure and a temperature of 100° C. In some cases the cloud point may be higher than 75° F. (24° C.). A heavy hydrocarbon composition of the invention, having an end boiling point above 1,250° F. (677° C.), with respective cloud and pour points of 1° C. and −31° C., has been made according to the invention. Low temperature property requirements of both a heavy lubricant base stock and a finished heavy lubricant will vary and can depend on both the application for which they are is intended and the geographical location in which they will be used. A heavy lubricant composition is prepared by forming a mixture of a heavy lubricant base stock of the invention and an effective amount of at least one additive or, more typically, an additive package containing more than one additive, as mentioned above. The heavy lubricant base stock of the invention used in forming the mixture will typically have been mildly hydrofinished and/or dehazed after hydrodewaxing to improve its color, appearance and stability.

As is known, haze is cloudiness or a lack of clarity, and is an appearance factor. Dehazing is typically achieved by either catalytic or absorptive methods to remove those constituents that result in haziness. Hydrofinishing is a very mild, relatively cold hydrogenating process, which employs a catalyst, hydrogen and mild reaction conditions to remove trace amounts of heteroatom compounds, aromatics and olefins, to improve oxidation stability and color. Hydrofinishing reaction conditions include a temperature of from 302 to 662° F. (150 to 350° C.) and preferably from 302 to 482°

F. (150 to 250° C.), a total pressure of from 400 to 3000 psig (2859 to 20786 kPa), a liquid hourly space velocity ranging from 0.1 to 5 LHSV ($hr^{-1}$) and preferably 0.5 to 3 $hr^{-1}$. The hydrogen treat gas rate will range from 2550 to 10000 scf/B (44.5 to 1780 $m^3/m^3$). The catalyst will comprise a support component and one or catalytic metal components of metal from Groups VIB (Mo, W, Cr) and/or iron group (Ni, Co) and noble metals (Pt, Pd) of Group VIII. The Groups VIB and VIII referred to herein, refers to Groups VIB and VIII as found in the Sargent-Welch Periodic Table of the Elements copyrighted in 1968 by the Sargent-Welch Scientific Company. The metal or metals may be present from as little as 0.1 wt % for noble metals, to as high as 30 wt % of the catalyst composition for non-noble metals. Preferred support materials are low in acid and include, for example, amorphous or crystalline metal oxides such as alumina, silica, silica alumina and ultra large pore crystalline materials known as mesoporous crystalline materials, of which MCM-41 is a preferred support component. The preparation and use of MCM-41 is disclosed, for example, in U.S. Pat. Nos. 5,098,684, 5,227,353 and 5,573,657.

The waxy feed or Fischer-Tropsch wax comprises the waxy hydrocarbon fraction produced in a Fischer-Tropsch hydrocarbon synthesis reactor, which is liquid at the reaction conditions. It is referred to as wax, because it is solid at 75° F. (24° C.) and one atmosphere (101 kPa) pressure. It must contain sufficient waxy material boiling above 1000° F. (538° C.) to produce the heavy hydrocarbon composition of the invention. The waxy feed is typically dewaxed in one or more catalytic dewaxing steps in which the feed is contacted with hydrogen and a dewaxing catalyst under dewaxing conditions. The iso- to normal paraffin ratio is measured by performing GC-FID for a composition containing molecules with up to 20 carbon atoms and a combination of GC-FID with $^{13}C$-NMR for a composition containing molecules with ≧20 carbon atoms. Aromatics are determined by X-Ray Fluorescence (XRF), as described in ASTM Standard D-2622. Sulfur is measured by XRF as per ASTM standard D-2622 and nitrogen by syringe/inlet oxidative combustion with chemiluminescence detection per ASTM standard D-4629.

The catalyst useful in the hydrodewaxing step comprises a solid acid component, a hydrogenation component and a binder. Illustrative, but nonlimiting examples of suitable catalyst components useful for hydrodewaxing include, for example, ZSM-23, ZSM-35, ZSM-48, ZSM-57, ZSM-22 also known as theta one or TON, and the silica aluminophosphates known as SAPO's (e.g., SAPO-11, 31 and 41), SSZ-32, zeolite beta, mordenite and rare earth ion exchanged ferrierite. Also useful are alumina and amorphous silica aluminas.

As in the case of many other zeolite catalysts, it may be desired to incorporate the solid acid component with a matrix material also known as a binder, which is resistant to the temperatures and other conditions employed in the dewaxing process herein. Such matrix materials include active and inactive materials and synthetic or naturally occurring zeolites as well as inorganic materials such as clays, silica and/or metal oxides e.g., alumina. The latter may be either naturally occurring or in the form of gelatinous precipitates, sols or gels including mixtures of silica and metal oxides. Use of a material in conjunction with the solid acid component, i.e., combined therewith, which is active, may enhance the conversion and/or selectivity of the catalyst herein. Inactive materials suitably serve as diluents to control the amount of conversion in a given process so that products can be obtained economically and orderly without employing other means for controlling the rate or reaction. Frequently, crystalline silicate materials have been incorporated into naturally occurring clays, e.g., bentonite and kaolin. These materials, i.e., clays, oxides, etc., function, in part, as binders for the catalyst. It is desirable to provide a catalyst having good crush strength since in a petroleum refinery the catalyst is often subject to rough handling which tends to break the catalyst down into powder-like materials which cause problems in processing.

Naturally occurring clays which can be composited with the solid acid component include the montmorillonite and kaolin families which include the sub-bentonites, and the kaolins commonly known as Dixie, McNamee, Georgia and Florida clays, or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the solid acid component can be composited with a porous matrix material such as silica-alumina, silica-magnesia, silica-zirconia, silica-thoria, silica-beryllia, silica-titania, as well as ternary compositions such as silica-alumina-thoria, silica-alumina-zirconia, silica-alumina-magnesia and silica-magnesia-zirconia. The matrix can be in the form of a cogel. Mixtures of these components can also be used. The relative proportions of finely divided solid acid component and inorganic oxide gel matrix vary widely with the crystalline silicate content ranging from about 1 to about 90 percent by weight, and more usually in the range of about 2 to about 80 percent by weight, of the composite. ZSM-48 is preferably used.

The hydrogenation component will comprise at least one Group VIII metal component and preferably at least one noble Group VIII metal component, as in Pt and Pd. Noble metal concentrations will range from about 0.1–5 wt % of the metal, and more typically from about 0.2–1 wt %, based on the total catalyst weight, including the ZSM-48 zeolite component and any binder used in the catalyst composite. The Group VIII referred to herein refers to Group VIII as found in the Sargent-Welch Periodic Table of the Elements copyrighted in 1968 by the Sargent-Welch Scientific Company.

The preparation of ZSM-48 (ZSM-48 zeolites include EU-2, EU-11 and ZBM-30 which are structurally equivalent) is well known and is disclosed, for example, in U.S. Pat. Nos. 4,397,827; 4,585,747 and 5,075,269, and EP 0 142 317, the disclosures of which are incorporated herein by reference. Other hydrodewaxing catalysts useful in the practice of the invention, include any of the well known catalysts that dewax mostly by isomerization and not by cracking or hydrocracking. Zeolites comprising ten and twelve membered ring structures are useful as dewaxing catalysts, particularly when combined with a catalytic metal hydrogenating component. Hydrodewaxing reaction conditions employed to produce a hydrocarbon or heavy lubricant composition of the invention include a respective temperature, hydrogen partial pressure and space velocity broadly ranging from 450–750° F. (232–399° C.), 10–2,000 psig (69–13790 kPa), and 0.1–5.0 LHSV. These conditions will more generally range from 500–700° F. (260–371° C.), 100–1000 psig (690–6895 kPa) and 0.5–3.0 LHSV, a pressure of from 200–700 psig (1379–4827 kPa) more typical.

EXAMPLES

Example 1

In this example, the wax feed comprised the entire 430° F.+ (221° C.) waxy hydrocarbon fraction produced in a slurry Fischer-Tropsch hydrocarbon synthesis reactor, that contained a titania supported, rhenium-promoted, non-shifting cobalt hydrocarbon synthesis catalyst. The wax comprised at least 90 wt % normal paraffinic hydrocarbons and 26.2 wt % of a 1000° F.+ (538° C.) fraction. It was hydrodewaxed with hydrogen in the presence of a ZSM-48 hydrodewaxing catalyst with a Pt noble metal component to form an isomerate. The isomerate was fractionated to remove the 700° F.− (371° C.−) hydrocarbons and the remaining 700° F.+ (371° C.+) fraction then fractionated to remove and recover a 950° F.+ (510° C.+) heavy lubricant isomerate fraction. This heavy isomerate fraction was then further hydrodewaxed with hydrogen, over the same ZSM-48 hydrodewaxing catalyst in a separate reactor, to form heavy hydrocarbon compositions or heavy lubricant base stocks of the invention. The hydrodewaxing conditions in the first and second reactors included respective temperatures of 586° F. (308° C.) and 616° F. (324° C.) and a low hydrogen pressure of 250 psi (1724 kPa). These compositions, the properties of which are shown in the Table, had kinematic viscosities of 13 and 15 cSt at 100° C.

The ZSM-48 hydrodewaxing catalyst in both reactors comprised 0.6 wt % Pt as the hydrogenating component, on a composite of the hydrogen form of a ZSM-48 zeolite and an alumina binder. The hydrogen form of the ZSM-48 zeolite was prepared according to the procedure in U.S. Pat. No. 5,075,269, the disclosure of which is incorporated herein by reference. The Pt component was added by impregnation, followed by calcining and reduction, using known procedures.

Gas chromatograph distillations (GCD) were conducted using a high temperature GCD method modification of ASTM D-5307. The column consisted of a single capillary column with a thin liquid phase, less than 0.2 microns. External standards were used, consisting of a boiling point calibrant ranging from 5 to 100 carbons. A temperature programmed injector was used and, prior to injection, the samples were gently warmed using hot water. Boiling ranges were determined using this method and the T5 and T95 GCD results. Cloud point values were measured using ASTM D-5773 for Phase Two Tec Instruments, under the lubricant procedure method. Pour point was measured according to ASTM D-5950 for ISL Auto Pour Point measurement. Cloud and pour points in the Table below are given in ° C. Viscosity and viscosity index were measured according to the ASTM protocols D-445 and D-2270, respectively.

Example 2

In this example, the wax feed was Paraflint C-80, a commercially available, hydrotreated Fischer-Tropsch wax produced by Sasol in a fixed bed Fischer-Tropsch reactor from a shifting iron catalyst. The untreated raw wax contains relatively high levels of aromatic and aliphatic unsaturates, and heteroatom compounds, which is hydrotreated to produce the Paraflint C-80 wax. This solid wax is a distillate fraction having a viscosity ranging from 6–10 cSt at 100° C. and a nominal T5 boiling point of about 850° F. (454° C.). It was hydrodewaxed with hydrogen in a single reactor, in the presence of a Pt/ZSM-48 catalyst similar to that used above, but which had been sulfided. The hydro-dewaxing reaction pressure was 1000 psi (6895 kPa). The hydrodewaxing product was fractionated by distillation to give a heavy hydrocarbon composition of the invention with a viscosity of 11 cSt at 100° C., and its properties are also shown in the Table.

Comparative Example A

This run was similar to that of Example 1, except that the nominally 700–950° F. (371–510° C.) isomerate was then further hydrodewaxed with hydrogen, over the same ZSM-48 hydrodewaxing catalyst in a separate reactor, to form a composition not of the invention, which had a viscosity of 4 cSt at 100° C. The hydrodewaxing conditions in the first and second reactors included respective temperatures of 586° F. (308° C.) and 597° F. (314° C.) and a low hydrogen pressure of 250 psi (1724 kPa). This comparative composition is shown in the Table.

Comparative Example B

This was similar to Example 2 regarding the feed, catalyst and a single hydrodewaxing reactor. Two compositions, having viscosities of 6 and 8 cSt at 100° C., were produced by fractionating the hydrodewaxed product by distillation. Neither of these two compositions are compositions of the invention and are included in the Table below for comparative purposes.

| | | THE INVENTION | | | Not the Invention | | |
|---|---|---|---|---|---|---|---|
| Viscosity, 100° C. | | 11 cSt | 13 cSt | 15 cSt | 8 cSt | 6 cSt | 4 cSt |
| $^1$H NMR* | % $CH_3$ | 23.0 | 21.8 | 21.5 | 26.6 | 25.9 | 25.4 |
| | % $CH_2$ | 75.5 | 76.6 | 76.9 | 71.4 | 72.3 | 72.7 |
| | % CH | 1.4 | 1.6 | 1.6 | 2.0 | 1.8 | 1.9 |
| | BI | 23.0 | 21.8 | 21.5 | 26.6 | 25.9 | 25.4 |
| $^{13}$C NMR** | % $CH_2 > 4$ | 18.6 | 19.7 | 19.9 | 11.3 | 14.6 | 16.4 |
| BI − 0.5($CH_2 > 4$) | | 13.74 | 11.98 | 11.59 | 20.93 | 18.6 | 17.2 |
| BI + 0.85($CH_2 > 4$) | | 38.80 | 38.55 | 38.39 | 36.17 | 38.3 | 39.4 |
| Pour Point, ° C. | | −39 | −32 | −32 | −60 | −40 | −22 |
| T5 | ° F. | 892 | 915 | 942 | 832 | 794 | 713 |
| | ° C. | 478 | 491 | 507 | 444 | 423 | 378 |

-continued

| | | THE INVENTION | | | Not the Invention | | |
|---|---|---|---|---|---|---|---|
| Viscosity, 100° C. | | 11 cSt | 13 cSt | 15 cSt | 8 cSt | 6 cSt | 4 cSt |
| T95 | ° F. | 1201 | 1199 | 1212 | 1059 | 992 | 903 |
| | ° C. | 649 | 648 | 655 | 571 | 533 | 484 |

*Percentage of the intensities of the $^1H$ (proton) resonances that can be attributed to $CH_3$, $CH_2$, and CH hydrogens
**Percentage of recurring methylene carbons which are four or more carbon atoms removed from an end group or branch The microstructure of the compositions in the Table was analyzed by carbon-13 NMR spectroscopy. Samples were prepared at w/w concentration of 20–25% in chloroform d-doped with 7.5 mg/ml $Cr(acac)_3$. Chemical shift referencing was performed with TMS set to 0.0 ppm. Spectra were acquired on a Varian Unity Plus 500, at a carbon Larmor frequency of 125.7 MHz, with 8000 coaveraged transients per spectrum. All spectra were acquired with a 90° excitation pulse on carbon, inverse gated WALTZ-16 decoupling on protons (during the 0.8 second acquisition time), and a recycle delay of 6 seconds. Sample preparation and data acquisition were performed at 50° C. The data acquisition parameters (chromium doping, relaxation decay, inverse gated decoupling) were chosen to insure accurate and quantitative integrals. With regard to the NMR techniques, the data acquisition and calculations, reference is also made to U.S. Pat. No. 6,090,989.

Proton NMR analysis of the samples was performed in a 5 mm switchable probe, with approximately 80 mg samples dissolved in 1 gm chloroform-d. Sample preparation and data acquisition were performed at 50° C. on a Varian Unity Plus 500. Free induction decays of 64 coaveraged transients were acquired, employing a 90° excitation pulse, a relaxation decay of 8.4 seconds, and an acquisition time of 3.2 seconds. No relaxation agent was used in the proton NMR.

These data show that the heavy hydrocarbon compositions of the invention (those having viscosities of 11, 13 and 15 cSt) have molecules in which the branching index (BI), and the proximity of branching or branching proximity ($CH_2$>4), are such that:

(a) $BI-0.5(CH_2>4)<15$;

(b) $BI+0.85(CH_2>4)<45$;

as measured over the heavy hydrocarbon composition as a whole. In addition, the data show that for heavy hydrocarbon compositions of the invention, BI is typically less than 25, and the branching proximity ($CH_2$>4) is typically greater than 17.

The FIGURE is a graph plotting the BI and % $CH_2$>4 values derived from NMR spectra of the heavy hydrocarbon compositions of the invention, the comparative examples of this application, and the data of U.S. Pat. No. 6,090,989 which includes other hydrocarbon compositions. The disclosure of U.S. Pat. No. 6,090,989 is incorporated herein in its entirety by reference. The shaded area on the plot defines the NMR parameter space of the heavy hydrocarbon compositions of the invention. Only the heavy hydrocarbon compositions of this invention, which are preferably derived from Fischer-Tropsch synthesized waxy hydrocarbons, and PAO base stocks fall in this area of parameter space. The molecular composition of the PAO stocks are different from the heavy hydrocarbon compositions of the invention in that (i) they do not contain hydrocarbon molecules having consecutive numbers of carbon atoms, (ii) the percentage of hydrogen atoms from $CH_3$ groups on the molecules is below 15, whereas those for the composition of the invention are typically above 20, (ii) the percentage of hydrogens from CH groups for the PAO stocks is above 3, whereas for the compositions of the invention it is typically less than 2.

What is claimed is:

1. A heavy hydrocarbon composition comprising at least 95 wt % paraffin molecules, of which at least 90 wt % are isoparaffins, containing hydrocarbon molecules having consecutive numbers of carbon atoms, is a liquid at 100° C., at which temperature its kinematic viscosity, as measured by ASTM D-445, is above 8 cSt, has an initial boiling point of least 850° F. (454° C.) and an end boiling point of at least 1000° F. (538° C.), wherein the branching index (BI), as measured by the percentage of methyl hydrogens, and the branching proximity ($CH_2$>4), as measured by the percentage of recurring methylene carbons which are four or more carbon atoms removed from an end group or branch, of said isoparaffinic hydrocarbon molecules, are such that:

(a) $BI-0.5(CH_2>4)<15$; and (b) $BI+0.85(CH_2>4)<45$;

as measured over the heavy hydrocarbon composition as a whole.

2. A composition according to claim 1 wherein said branching index (BI) is less than 24 and said composition contains at least 95 wt % of hydrocarbon molecules having at least thirty carbon atoms.

3. A composition according to claim 2 wherein said branching proximity ($CH_2$>4) is greater than 17.

4. A composition according to claim 3 wherein less than half the branches of said isoparaffinic hydrocarbon molecules have two or more carbon atoms.

5. A composition according to claim 4 wherein less than 25% of the total number of carbon atoms in said isoparaffinic hydrocarbon molecules are present in said branches.

6. A composition according to claim 5 comprising at least 98 wt % saturated, paraffinic hydrocarbons, of which at least 90 wt % are non-cyclic hydrocarbons and not more than 5 wt % cyclic hydrocarbons.

7. A composition according to claim 6 wherein less than 25% of the total number of said branches have three or more carbon atoms.

8. A composition according to claim 7 wherein less than 15% of the total number of said branches have three or more carbon atoms.

9. A composition according to claim 8 having an end boiling point above 1050° F. (566° C.).

10. A composition according to claim 9 comprising at least 95 wt % hydrocarbons having thirty or more carbon atoms.

11. A composition according to claim 10 having a T5 boiling point of at least 900° F.

12. A composition according to claim 8 wherein less than 25% of the total number of carbon atoms in said isoparaffin hydrocarbon molecules are present in said branches.

13. A composition according to claim 12 that has been hydrofinished and optionally dehazed.

14. A composition according to claim 13 which is a liquid at conditions of 75° F. (24° C.) and one atmosphere (101 kPa) pressure.

15. A composition according to claim 12 comprising at least a portion of one or more of a heavy white oil, a pharmaceutical oil, a carrier or base for medicinal formulations and as a component of chemical and pharmaceutical manufacturing processes.

16. A composition according to claim 1 which is a synthetic composition.

17. A composition according to claim 16 wherein said branching index BI is less than 24 and said composition contains at least 95 wt % of hydrocarbon atoms having at least thirty carbon atoms.

18. A composition according to claim 17 wherein said branching proximity ($CH_2$>4) is greater than 17.

19. A composition according to claim 18 wherein less than half the branches of said isoparaffinic hydrocarbon molecules have two or more carbon atoms.

20. A composition according to claim 8 having an end boiling point above 1050° F. (566° C.).

21. A composition according to claim 20 comprising at least 95 wt % hydrocarbons having thirty or more carbon atoms.

22. A composition according to claim 21 that has been hydrofinished and optionally dehazed.

23. A composition according to claim 22 having a T5 boiling point of at least 900° F.

24. A method for improving lubrication properties between moving parts comprising providing the composition according to claim 1; and using said composition in or as one or more of a heavy lubricant base stock, heavy white oil, a pharmaceutical oil, a carrier or base for medicinal formulations and as a component of chemical and pharmaceutical manufacturing processes.

25. A method for reducing the pour and cloud point of a heavy lubricant base stock comprising using the composition according to claim 1.

26. A method for improving lubrication properties between moving parts comprising using the composition according to claim 1 in or as a heavy lubricant base stock.

27. The method according to of claim 26, wherein said heavy lubricant base stock comprises one or more lubricant additives.

* * * * *